United States Patent [19]

Huigen et al.

[11] Patent Number: 4,723,602

[45] Date of Patent: Feb. 9, 1988

[54] HEAT EXCHANGER WITH MULTIWALL TUBES

[75] Inventors: Johannes H. Huigen, Nootdorp; Theodoor J. Tromp, Gouderak; Jan Vrijen, Noordwijkerhout; Johan K. van Westenbrugge, Voorburg, all of Netherlands

[73] Assignee: B.V. Neratoom, The Hague, Netherlands

[21] Appl. No.: 163,063

[22] Filed: Jun. 26, 1980

[30] Foreign Application Priority Data

Jun. 29, 1979 [NL] Netherlands ..... 7905101

[51] Int. Cl.[4] ..... F28F 21/00

[52] U.S. Cl. ..... 165/180; 165/185; 165/70; 122/DIG. 13; 138/143; 138/145

[58] Field of Search ..... 165/180, 70, 133, 185; 122/DIG. 13; 138/140, 143, 145

[56] References Cited

U.S. PATENT DOCUMENTS

| | | | |
|---|---|---|---|
| 1,952,896 | 3/1934 | Rudorff | 165/180 |
| 3,804,161 | 4/1974 | Nowak | 165/180 |
| 4,092,697 | 5/1978 | Spaight | 165/185 |
| 4,275,484 | 6/1981 | Popplewell et al. | 165/180 |
| 4,299,715 | 11/1981 | Whitfield et al. | 165/185 |

FOREIGN PATENT DOCUMENTS

| | | | |
|---|---|---|---|
| 607017 | 12/1934 | Fed. Rep. of Germany . | |
| 921424 | 12/1954 | Fed. Rep. of Germany . | |
| 1117148 | 11/1961 | Fed. Rep. of Germany . | |
| 1231270 | 12/1966 | Fed. Rep. of Germany | 165/180 |
| 1259656 | 1/1968 | Fed. Rep. of Germany . | |
| 2236814 | 2/1974 | Fed. Rep. of Germany | 165/185 |
| 610484 | 10/1960 | Italy | 165/180 |
| 955696 | 8/1964 | United Kingdom | 165/185 |
| 985850 | 3/1965 | United Kingdom . | |

*Primary Examiner*—Albert W. Davis, Jr.
*Attorney, Agent, or Firm*—Kenyon & Kenyon

[57] ABSTRACT

A heat exchanger having a housing with one or more tubes therein for the transportation of a first fluid through the tubes and a second fluid through the housing and at least partially around the tube or tubes, in which each tube includes two concentric walls with a thin layer or thin layers of a relatively soft material between them applied to the outer surface of the inner wall and to the inner surface of the outer wall.

5 Claims, 4 Drawing Figures

HEAT EXCHANGER WITH MULTIWALL TUBES

This invention relates to a heat exchanger and a tube for use therein.

The kind of heat exchanger to which the invention relates comprises a housing having openings therein for supplying and discharging a first fluid and one or more tubes disposed within the housing for transportation of said first fluid through the housing from a space in the vicinity of the supply opening to a space in the vicinity of the discharge opening, openings for supplying and discharging a second fluid, and means for transporting said second fluid through the housing and at least partially around the tube or tubes.

Heat exchangers of this kind are generally known and are used in many technical fields. One problem which may present itself with such heat exchangers is the occurrence of a leak in one of the tubes through which the first fluid flows. In the event of a leak, the first fluid may come into contact with the second fluid, which may be highly undesirable, in particular in cases in which the apparatus operates with two fluids which violently react with each other. One example of a heat exchanger with two violently reacting fluids is the steam generator in the cooling circuit of a nuclear reactor cooled with liquid sodium. To reduce the risk of the occurrence of leaks and reactions resulting therefrom, multi-layer tubes are sometimes used. Such multi-layer tubes consist in essence of two or more concentric pipes of such dimensions that adjacent pipes are just in contact with each other. In spite of the fact that the outer surface of an inner pipe or wall is in direct contact with the inner surface of an outer pipe or wall, the contacting surface between two adjacent walls has a relatively high heat resistance. As a result, there is not optimum transfer of heat from a fluid flowing outside around the multi-layer tube to a fluid flowing through the tube. The heat resistance can be reduced by soldering the pipe walls together, but this has the disadvantage of losing the crack-arresting effect of the interface.

SUMMARY OF THE INVENTION

It is an object of the present invention to provide a heat exchanger and a tube for use therein, with which the problems outlined above do not occur or at any rate occur to a much lesser extent. This object is attained, according to the invention, with a heat exchanger in which each tube comprises two or more adjoining concentric walls between which a thin layer or thin layers of a relatively soft material compared with the material of the concentric walls, is provided on the outer surface of the inner wall and on the inner surface of the outer wall. A tube built up from two or more adjoining concentric walls is characterized, according to the invention by one or more thin layers of a relatively soft material on the outer surface of the inner wall and the inner surface of the outer wall, of each two adjoining walls.

Preferably, according to the invention, each layer of relatively soft material comprises a substance having a good heat conductivity. Suitable material is a pure metal, for example, pure copper or aluminum or a paste, depending on the operating temperature contemplated. The layers have preferably an average thickness in the order of magnitude of the roughness profile of the respective contacting wall surfaces. Good results have been obtained, for example, with a single layer in a thickness of 25–50 μm with a roughness of 5 μm for both contacting wall surfaces.

According to the invention, the interface between each pair of adjoining surfaces of a multi-wall pipe is, as it were, filled with a soft layer, whereby the metallic contact between the pipe walls is improved. As a result, the heat resistance is reduced, whereas the crack-arresting qualities are retained. The improvement in heat conductivity can be explained as follows. Usually, heat is conducted only via the peaks of the roughness profile where the layers of the pipe are in contact with each other, and via gas commonly held in the interspace between the peaks, which gas may account for as much as 95% of the heat transfer. By virtue of the fact that the troughs of the roughness profile are filled with a relatively soft material which is a good heat conductor, the contacting surface area between the two pipe layers, which without the "filling" amounts to only a few percents of the nominal area, is considerably increased. As a result the heat conductivity is increased as well.

BRIEF DESCRIPTION OF THE DRAWINGS

The invention will be described in more detail with reference to the accompanying drawings, in which.

DETAILED DESCRIPTION

Figure 1:
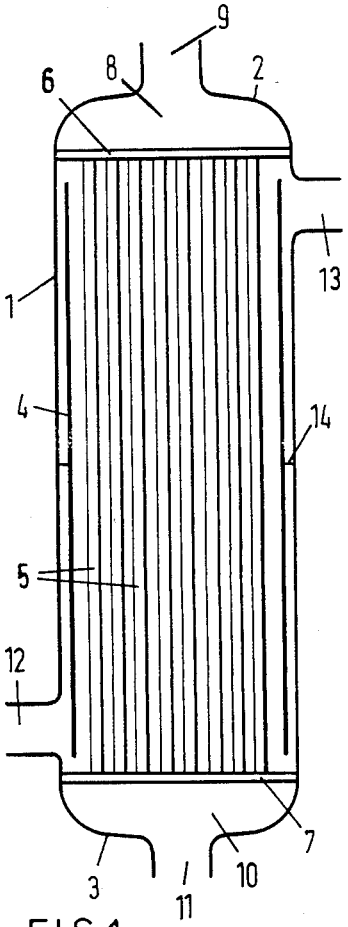
FIG. 1 is a cross-sectional view of an embodiment of the heat exchanger according to the present invention.

Referring to the drawings, FIG. 1 shows an embodiment of a heat exchanger according to the invention. The heat exchanger comprises a housing 1, which in essence comprises a cylindrical vessel closed at the top and bottom with dome-shaped covers 2 and 3. Disposed within the housing 1 is an inner jacket or baffle 4. Arranged within inner jacket or baffle 4 is a bank of tubes 5. Each tube 5 of the bank extends between a top tube sheet 6 and a bottom tube sheet 7. Tube sheet 6 and cover 2 define a header 8 between them. In cover 2, there is an opening to which a conduit 9 is connected. Between tube sheet 7 and cover 3 is a header 10. In cover 3 there is also an opening, to which a conduit 11 is connected. In operation, a first fluid is introduced through conduit 9 into the header 8. From header 8 the fluid flows through tubes 5 to header 10, whence it is discharged through conduit 11.

Formed in the sidewall of housing 1 are two openings. To the first opening a conduit 12 is connected and to the second opening a conduit 13. In operation, a second fluid is supplied through conduit 12. This second fluid moves through housing 1 around pipes 5 between pipe sheets 6 and 7 to the second opening, whence the fluid is discharged through conduit 13. An annular partition 14 prevents the second fluid from flowing from one opening directly to the other through the space between housing 1 and the inner jacket or baffle 4.

The first fluid passed through the heat exchanger is, for example, a cool fluid and the second fluid is, for example, a hot fluid. The hot fluid flows around tubes 5, through which the cool fluid is passed, and gives off a portion of its heat to the cool fluid. Thus the second, relatively hot, fluid leaves the heat exchanger at a lower temperature than that which it had when it entered. Conversely, the cool fluid when leaving the apparatus will have a higher temperature than upon entry.

In heat exchangers, first and second fluids of widely different natures are used. In a heat exchanger, for example, included in the cooling circuit of a sodium-cooled nuclear reactor, the hot fluid is liquid sodium and the cooler fluid may be water, which is converted into steam by the hot fluid. In a heat exchanger of this type it is highly undesirable that the first fluid (water or steam) could come into contact with the second fluid (liquid sodium). Such a contact could occur if one of the tubes 5 sprang a leak. In order to prevent as much as possible that when there is a leak in one of tubes 5 there will be an undesirable contact between the first and the second fluid, tubes 5 are formed as multi-layer pipes in the apparatus according to the invention. A cross-sectional view of such a tube, in the form of duplex pipes, is shown in FIG. 2.

Figure 2:
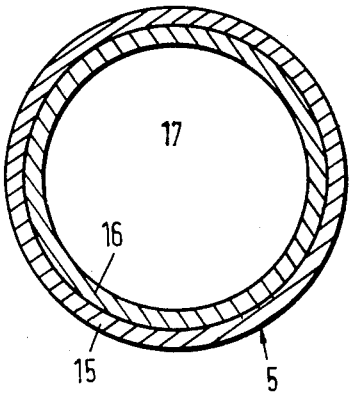
FIG. 2 is a cross-sectional view of a duplex pipe from the heat exchanger shown in FIG. 1.

As shown in FIG. 2, the tube comprises an outer wall or outer pipe 15 and an inner wall or inner pipe 16 arranged within it. The walls 15 and 16 are concentric and adjoin one another. The first fluid is passed through the interior 7 of tube 5. As will be explained hereinafter, if no further measures are taken, the transfer of heat from a fluid passed around the multi-wall tube to the fluid in the interior 17 is not always quite so good.

Figure 3:
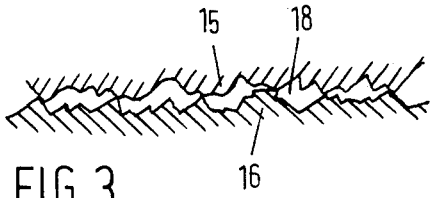
FIG. 3 is a greatly enlarged cross-sectional view of a portion of the contacting surface between two concentric pipe walls of a multi-wall tube in which the invention was not applied.

Walls 15 and 16 usually adjoin one another very closely, while furthermore any spaces which there may be between the walls may be filled with an inert gas, for example helium. FIG. 3 shows a greatly enlarged cross-sectional view through the two walls 15 and 16 in the vicinity of the contacting surfaces. The walls have a certain surface roughness, so that the surfaces are in contact with each other only where peaks in the profile of one wall surface touch the adjoining wall surface. Apart from any gas which may be present, the space between walls 15 and 16 is unfilled. With this structure, heat transfer takes place through the places where there is contact between the walls 15 and 16, i.e. via the peaks of the roughness profile, and via the gas present. The contacting surface area of the peaks is only a few percents of the nominal surface area. In practice, the gas turns out to account for up to 95% of the heat transfer. This manner of heat transfer is considerably poorer than if there were more direct contacts between walls 15 and 16.

Figure 4:
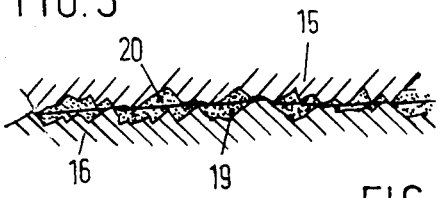
FIG. 4 is a view similar to FIG. 3, but showing a portion of a multi-wall tube according to the present invention.

According to the present invention, there results improved heat transfer between the adjoining walls of a multi-wall tube owing to there being provided a thin layer of a soft metal or a heat-conducting paste on the facing surfaces of adjoining walls. A greatly magnified cross-sectional view of two walls 15 and 16 thus treated in the vicinity of their contacting surfaces is shown in FIG. 4. Owing to the application of a thin layer 19 on the outer surface of inner pipe 16, the troughs of the roughness profile are filled. The same applies to the outer pipe 15, within which a thin layer 20 is applied. The application of a thin layer of a relatively soft material which is a good heat conductor considerably improves the heat transfer between pipes 15 and 16. As a matter of fact, as the thin layer applied is of soft material, the roughness profile is smoothed, so that the contacting surface area is considerably increased.

As shown in FIG. 4, a thin layer of a relatively soft material may be applied to both the outer surface of the inner wall of the duplex pipes 15, 16 and the inner surface of the outer wall. Instead, however, a single thin layer may be arranged between the two pipe walls, such as a foil of soft copper. Such a foil may have a thickness, for example, equal to the average spacing between the two pipe walls. As the foil consists of relatively soft material, when it is clamped in between the pipe walls it will follow the roughness profiles of the pipe surfaces and thereby fill the troughs in the profiles.

In the case of FIG. 4, which shows separate thin layers on the two contacting pipe wall surfaces, a suitable possibility would be, for example, layers of heat-conducting paste, applied in a suitable manner, for example, by rolling or by means of a doctor blade.

We claim:

1. A heat exchanger comprising a housing having openings therein for the supply and discharge of a first fluid and one or more tubes disposed within the housing for the transportation of said first fluid through the housing from a space in the vicinity of the supply opening to a space in the vicinity of the discharge opening, openings for supplying and discharging a second fluid, and means for directing said second fluid through the housing and at least partially around the one or more tubes, wherein each tube comprises at least two adjoining concentric walls and at least one thin layer of a material softer than the material of said walls applied on the outer surface of the inner wall and on the inner surface of the outer wall in an amount sufficient to fill essentially all voids in the surfaces of said walls so as to significantly increase the thermal conductivity across the interface of said concentric walls and said thin layer has an average thickness in the order of magnitude of the roughness profile of the respective contacting wall surface.

2. A heat exchanger according to claim 1, wherein the at least one layer of relatively soft material comprises a good heat conductor.

3. A heat exchanger according to claim 2, wherein the at least one layer of relatively soft material consists of a pure metal.

4. A heat exchanger according to claim 2 wherein the at least one layer of relatively soft material comprises a paste.

5. A tube built up from two or more adjoining concentric walls, wherein the improvement comprises at least one thin layer of a heat conducting material softer than the material of said walls on the outer surface of the inner wall and the inner surface of the outer wall of two adjoining walls in an amount sufficient to fill essentially all voids in the surfaces of said walls so as to significantly increase the thermal conductivity across the interface of said concentric walls and said thin layer has an average thickness in the order of magnitude of the roughness profile of the respective contacting wall surface.

* * * * *